US007559788B2

(12) United States Patent
Legg

(10) Patent No.: US 7,559,788 B2
(45) Date of Patent: Jul. 14, 2009

(54) CONNECTOR RETAINERS AND METHODS OF SECURING A CONNECTOR IN A RECEPTACLE

(75) Inventor: Ronald W Legg, Palm Harbor, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 0 days.

(21) Appl. No.: 11/933,920

(22) Filed: Nov. 1, 2007

(65) Prior Publication Data

US 2008/0299824 A1 Dec. 4, 2008

Related U.S. Application Data

(60) Provisional application No. 60/941,885, filed on Jun. 4, 2007.

(51) Int. Cl.
*H01R 13/64* (2006.01)
*H01R 13/62* (2006.01)

(52) U.S. Cl. ..... 439/373; 439/371

(58) Field of Classification Search ..... 439/350, 439/357, 369, 370, 373, 371, 358
See application file for complete search history.

(56) References Cited

U.S. PATENT DOCUMENTS

| | | | | |
|---|---|---|---|---|
| 2,728,058 | A | 12/1955 | Phalen | |
| 3,328,748 | A | 6/1967 | Winter | |
| 3,570,361 | A | 3/1971 | Tinnerman | |
| 3,603,913 | A | 9/1971 | Hasty, Jr. | |
| 3,622,942 | A | 11/1971 | Rynk | |
| 3,638,169 | A | 1/1972 | Caveney et al. | |
| 3,732,526 | A | 5/1973 | Punako | |
| 3,889,909 | A | 6/1975 | Koscik | |
| 3,966,292 | A | 6/1976 | Schultz | |
| 4,017,139 | A | 4/1977 | Nelson | |
| 4,927,385 | A | 5/1990 | Cheng | |
| 4,932,897 | A | 6/1990 | Lee et al. | |
| 5,308,259 | A | 5/1994 | Liao | |
| 5,338,211 | A | 8/1994 | Kodama et al. | |
| 5,454,729 | A | 10/1995 | Went-Te | |
| 5,772,462 | A | 6/1998 | Osten | |
| 5,785,547 | A | 7/1998 | Cross et al. | |
| 5,842,450 | A | 12/1998 | Fort et al. | |
| 5,895,289 | A | 4/1999 | Smith | |
| 5,928,023 | A * | 7/1999 | Buckner et al. | 439/373 |
| 6,217,366 | B1 | 4/2001 | Weisstock | |
| 6,296,525 | B1 | 10/2001 | D'Addario et al. | |

(Continued)

OTHER PUBLICATIONS

Official Action, issued in connection with U.S. Appl. No. 11/864,161; mailed Apr. 24, 2008, 14 pages.

(Continued)

*Primary Examiner*—Javaid Nasri
(74) *Attorney, Agent, or Firm*—Hanley, Flight & Zimmerman, LLC

(57) ABSTRACT

Connector retainers and methods of securing a connector such as a universal serial bus (USB) connector or a video and audio switcher (VAS) connector in a receptacle are disclosed. A disclosed example retainer to retain a connector in a receptacle includes a projection to engage the housing of an electronic device to secure the retainer to a housing; and a mount adjacent the projection to secure the connector to the projection.

20 Claims, 6 Drawing Sheets

U.S. PATENT DOCUMENTS

| | | | |
|---|---|---|---|
| D467,492 | S | 12/2002 | Wieder |
| 6,491,539 | B1 | 12/2002 | Johnston |
| 6,491,541 | B2 | 12/2002 | Wakino |
| 6,568,964 | B2 | 5/2003 | D'Addario |
| 6,582,240 | B2 | 6/2003 | Suto |
| 6,612,619 | B2 | 9/2003 | Wieder |
| 6,745,330 | B1 | 6/2004 | Maillot |
| 6,802,725 | B2 | 10/2004 | Rowland et al. |
| 6,902,432 | B2 | 6/2005 | Morikawa et al. |
| 7,014,493 | B1 | 3/2006 | Battard |
| 7,094,099 | B2 | 8/2006 | Daggett et al. |
| 7,135,971 | B2 | 11/2006 | Kim |
| 7,192,308 | B2 | 3/2007 | Rodrigues et al. |
| 7,207,823 | B1 | 4/2007 | Yang |
| 2003/0224637 | A1 | 12/2003 | Ling |
| 2004/0038581 | A1 | 2/2004 | Brown |
| 2006/0107073 | A1 | 5/2006 | Lane et al. |

OTHER PUBLICATIONS

Official Action, issued in connection with U.S. Appl. No. 11/864,161; mailed Jan. 2, 2009, 11 pages.

Official Action, issued in connection with U.S. Appl. No. 11/864,161; mailed Feb. 26,2009, 6 pages.

* cited by examiner

CONNECTOR RETAINERS AND METHODS OF SECURING A CONNECTOR IN A RECEPTACLE

RELATED APPLICATIONS

This patent claims the benefit of U.S. Provisional Patent Application No. 60/941,885, filed Jun. 4, 2007, which is hereby incorporated herein by reference in its entirety.

TECHNICAL FIELD

The present disclosure pertains to optical and electrical connectors and, more particularly, to connector retainers and methods of securing an optical and/or electrical connector in a receptacle.

BACKGROUND

Many types of cables, such as USB (Universal Serial Bus) cables, or VAS (Video and Audio Switcher) cables, are used to electrically and/or optically connect components. For example, USB cables and/or PS2 cables are commonly used to connect peripheral devices to computers. Cables are commonly terminated in connectors that are specifically designed for connection to receptacles, also referred to as jacks or ports. The ports may be constructed in many different ways. For example, a port may be mounted behind a housing panel, mounted within a housing, or be an integral part of a housing. Irrespective of its precise structure and location, these ports are typically intended to receive a connector of a specific type via a male-female type connection. If, after a connector is seated in a port, the connector and/or cable is bumped and/or otherwise subjected to force and/or vibration, the connector may be accidentally disconnected from the corresponding jack. Such inadvertent disconnection of a connector from a port can result in inconvenience, power loss, and/or loss of data.

DETAILED DESCRIPTION

Although the following discloses example retainers for retaining a USB type A or B connector in a corresponding jack or port, or retaining a VAS type connector in a corresponding jack or port, with either type of port mounted within and/or accessible through an opening in a housing of an electronic device, persons of ordinary skill in the art will appreciate that the teachings of this disclosure are in no way limited to such connectors, jacks, and/or ports, and that the teachings of this disclosure are in no way limited to use with any particular type of housing or electronic device. On the contrary, it is contemplated that the teachings of this disclosure may be implemented in alternative environments of use such as for use with other types of connectors and/or ports (e.g., IEEE 1394 ports, etc.). For example, although the example retainers described herein are described in conjunction with connectors having cords or cables connected thereto, those having ordinary skill in the art will readily recognize that the example retainers may be used with devices that do not have cables or cords (e.g., a USB flash drive, etc.). Similarly the disclosed examples may be used with any type of optical and/or electronic device. For instance, a disclosed example retainer may be used to secure a connector (e.g., a USB connector) to a laptop computer, to a desktop computer, to a server and/or to a portable electronic device such as a cellular telephone, an MP3 player (e.g., an iPod), a personal digital assistant (PDA), a camera and/or to any other type of device to establish and/or maintain an electrical and/or optical connection with another device. Thus, the methods, apparatus, and/or articles of manufacture disclosed herein may be advantageously adapted to enhance or improve the retention of any type of electrical and/or optical connector in any type of electrical and/or optical receptacle (e.g., a jack or port) associated with any type of device. Accordingly, while the following describes example retainers and methods, persons of ordinary skill in the art will readily appreciate that the disclosed examples are not the only way to implement such retainers and/or methods.

In general, the example retainers and/or methods described herein assist in retaining a connector in a receptacle (e.g., a jack or port) even when the connector and/or a cable or device associated with the connector is subjected to a force tending to remove the connector from the port. In some examples, the port is accessible through an opening in a housing of an electronic device. An advantage of the examples disclosed herein is that a retainer may be employed on a retrofit basis, without requiring a housing modification, by utilizing the housing opening through which a receptacle is accessed.

Figure 1:
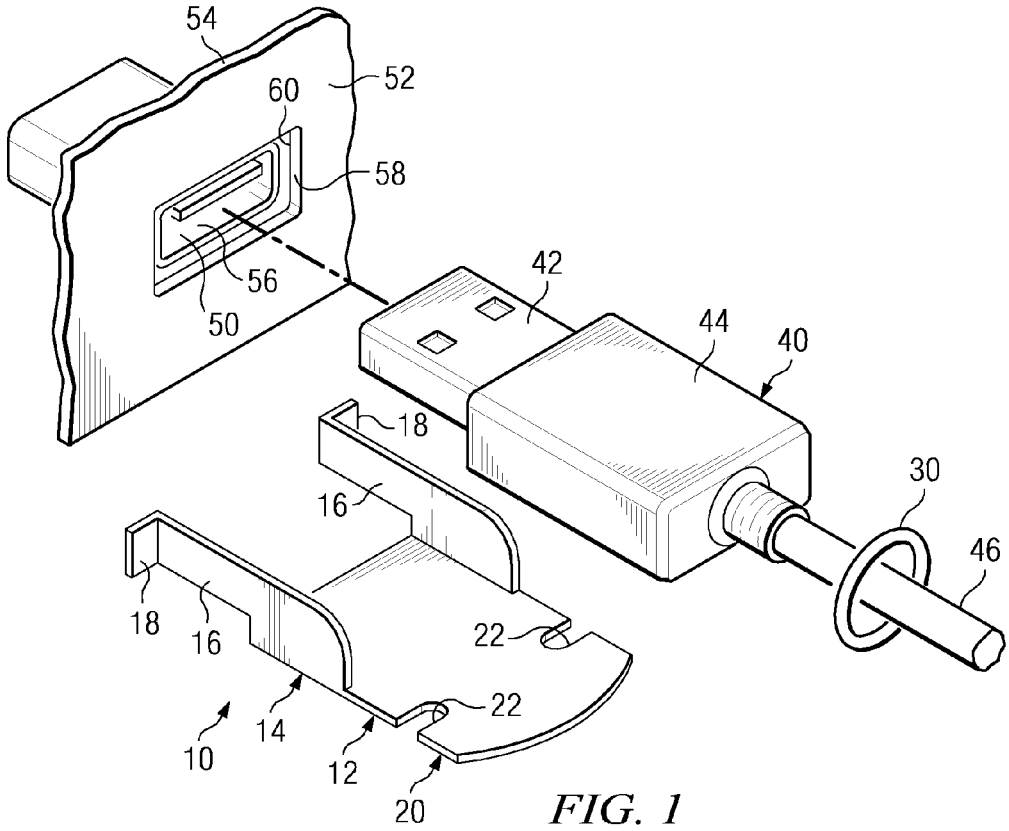
FIG. 1 is an exploded perspective view of a first example retainer to secure a first example connector in a first example port.
Figure 1A:
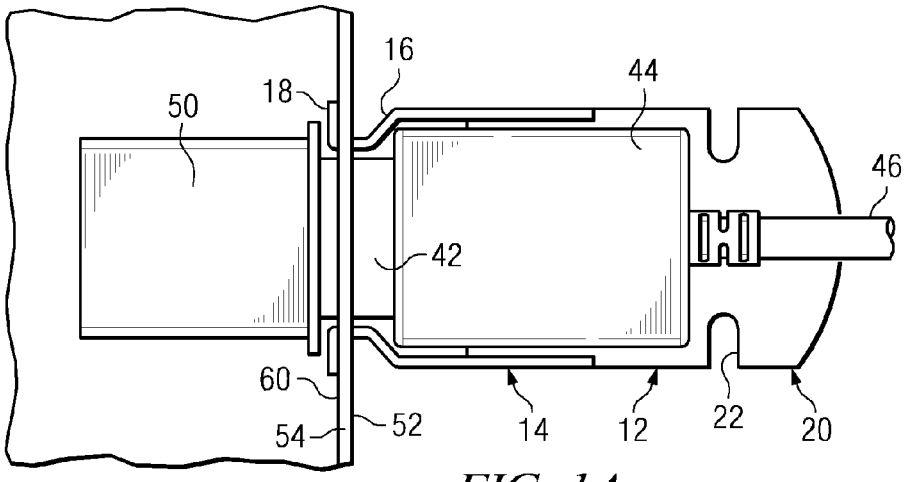
FIG. 1A is a top view of the first example retainer and the first example connector secured to the first example port.

A first example retainer 10 is illustrated in FIGS. 1 and 1A. The illustrated example retainer 10 includes a body 12 and a fastener 30. The body 12 of the retainer 10 comprises a projection 14 to engage a housing 54 to secure the retainer 10 to the housing 54; and a mount 20 adjacent the projection 14 to secure a connector 40 to the projection 14. In the illustrated example, the projection 14 comprises a port engaging portion that, in the example of FIG. 1, includes extension arms 16 that project outwardly from the mount 20. The arms 16 are located in substantial alignment with the edges of the mount 20. The extension arms 16 terminate in flanges 18 that are oriented substantially perpendicularly with respect to their respective arms 16.

As mentioned above, the body 12 also has a mount 20 to secure a connector 40 to the projection 14. In the illustrated example, the mount 20 is implemented as a connector engaging portion extending opposite the projection 14. The mount 20 includes notches 22 dimensioned to receive the fastener 30, which, in the example of FIG. 1, is implemented as a flexible member such as a continuous elastic band. Although the illustrated example employs a pair of notches 22, persons of ordinary skill in the art will readily appreciate that other numbers of notches 22 (e.g., 0, 1, 3, etc.) may be employed.

The retainer 10 in FIGS. 1 and 1A is shown in use with a USB type A connector 40. The connector 40 of the illustrated example includes an interconnect portion 42 and a housing or grasping portion 44 coupled to a cable 46 extending opposite the interconnect portion 42. In the example of FIGS. 1 and 1A, the connector 40 is shown engaging a corresponding USB type A port 50 (also referred to herein as a jack or receptacle). In this example, the port 50 is mounted behind a housing panel 52 of the housing 54 of an electronic device (not shown). The housing panel 52 includes an opening 56 to allow access to the port 50 from outside the housing 54. To couple the connector 40 to the port 50, the interconnect portion 42 of the connector 40 is passed through the opening 56 in the housing panel 52, and into the port 50 to make electrical connection therewith. In other words, the port 50 is mounted within housing 54, behind the housing panel 52, and is accessible through the housing opening 56.

In use, the retainer 10 of the illustrated example is connected to both the housing 54 and the connector 40, thereby retaining the interconnect portion 42 of the connector 40 in engagement with the port 50. In the illustrated example, the connection of the retainer 10 to the connector 40 is affected either via the grasping portion 44 or the cable 46. To connect the retainer 10 to the housing 54, the extension arms 16 are manually deflected inwardly toward one another to enable the flanges 18 to be inserted through the housing opening 56 in the housing panel 52. The extension arms 16 are then released, which allows the extension arms 16 to spring outwardly away from one another so that the extension arms 16 engage sides 58 of the housing opening 56 in the housing panel 52, and the flanges 18 engage a rear face 60 of the housing panel 52.

That is, during installation of the retainer 10, one or both of the extension arms 16 are manually squeezed by a user to enable the flanges 18 to fit through the housing opening 56. After the flanges 18 are fit through the housing opening 56, the user releases the extension arms 16 to thereby allow the flanges 18 to move outwardly and seat against the sides 58 of the opening 56 and inside the housing panel 52. Removal of the retainer 10 is affected by squeezing the extension arms 16 until the flanges 18 are sufficiently close enough to one another to fit at least one through the housing opening 56 and then withdrawing the extension arms 16 and the attendant flanges 18 from the housing opening 56. Depending on the particular structure of the extension arms 16 and the connector 40, the installation and removal of the retainer 10 may be carried out with or without the connector 40 being coupled or fastened to the retainer 10.

It will be appreciated that in many electronic devices, the port 50 is located a distance behind the housing panel 52, which results in the flanges 18 being received between the port 50 and the rear face 60 of the housing panel 52. As described above, depending on the structure of the extension arms 16 and the flanges 18, insertion of the flanges 18 through the housing opening 56 to engage the housing 54, the housing panel 52 and/or some other portion of the port/jack 50 involves at least temporary bending or deflection of at least one of the extension arms 16. In the example retainer 10 shown in FIGS. 1 and 1A, both extension arms 16 are inwardly deflected during insertion of the flanges 18 and may remain in a deflected position while the retainer 10 is located in the housing 54 through the housing opening 56. To this end, the extension arms 16 are preferably resilient to permit bending for insertion of the flanges 18 and expansion upon installation to maintain a snug fit when the retainer 10 is installed in a port. The body 12 of the example retainer 10 may be constructed of any type of material, such as stamped 0.010"-0.020" stainless steel half hard sheet or coil, molded plastic, or the like.

As described above, to maintain engagement between the interconnect portion 42 of the connector 40 and the port 50, the connector 40 is coupled to the mount 20 of the retainer 10. In some examples, after the retainer 10 has been installed within the housing 54, this connection is achieved by moving the connector 40 to a position adjacent the mount 20 of the body 12 of the connector retainer 10 such that the interconnect portion 42 is inserted into the port 50. Then, the fastener 30 is connected to the connector 40 via (1) the grasping portion 44 and/or the cable portion 46, and (2) the mount 20 by, for example, locating the fastener 30 within at least one of the notches 22 in the mount 20. However, in other examples, the retainer 10 may be coupled to the connector 40 before the retainer 10 is engaged to the port 50, and the retainer 10 and the connector 40 may be subsequently installed into the port 50 at substantially the same time. In the illustrated example of FIGS. 1 and 1A, the interconnect portion 42 of the connector 40 prevents the flanges 18 from deflecting inwardly sufficient to enter or exit the opening 56, thereby suggesting that the retainer 10 should be coupled to the port 50 prior to the connector 40 being inserted into the opening 56.

In some examples, a fastener 30 need not be used. For example, a portion of the body 12 on the opposite side of the mount 20 from the projection 14 may include a stop or other projection to engage the housing portion 44 or the cable 46 of the connector 40. In another alternative example, a portion of the body 12 on the opposite side of the mount 20 from the projection 14 may be bent upwardly substantially perpendicularly to engage behind the housing portion 44 of the connector 40 to create a friction fit or interference fit with the housing 44 of the connector 40 to thereby obviate the need for an additional fastener such as a band, tie or the like.

With the retainer 10 installed, the connector 40 is prevented from being inadvertently disconnected or removed from the port 50, thereby maintaining electrical or optical connectivity between the interconnect portion 42 of the connector 40 and the port 50, even when the connector 40 is subjected to jostling or other removal force. Assembly of the example retainer 10 to the housing 54 and to the connector 40 readily permits intentional removal of the connector 40 from the port 50 by disconnecting the connector 40 from the retainer 10, and/or by disconnecting the retainer 10 from the housing 54. In the example of FIGS. 1 and 1A, it is preferable to remove the connector 40 from the retainer 10 prior to removing the retainer 10 from the port 50 because the removal of the retainer 10 from the housing 54 prior to removing the connector 40 from the retainer 10 may result in damage to the retainer 10 and/or the housing 54. It also will be appreciated that the strength of the pull out force required to overcome the retention capability of the retainer 10 is implementation dependent (e.g., it depends on features such as material strength, etc.) The material of the retainer 10 may be selected to yield when subjected to a fairly substantial removal force so as to avoid damage to the housing 54 of the electrical device while still performing the retention function in response to the application of most inadvertent removal forces.

Figure 2:
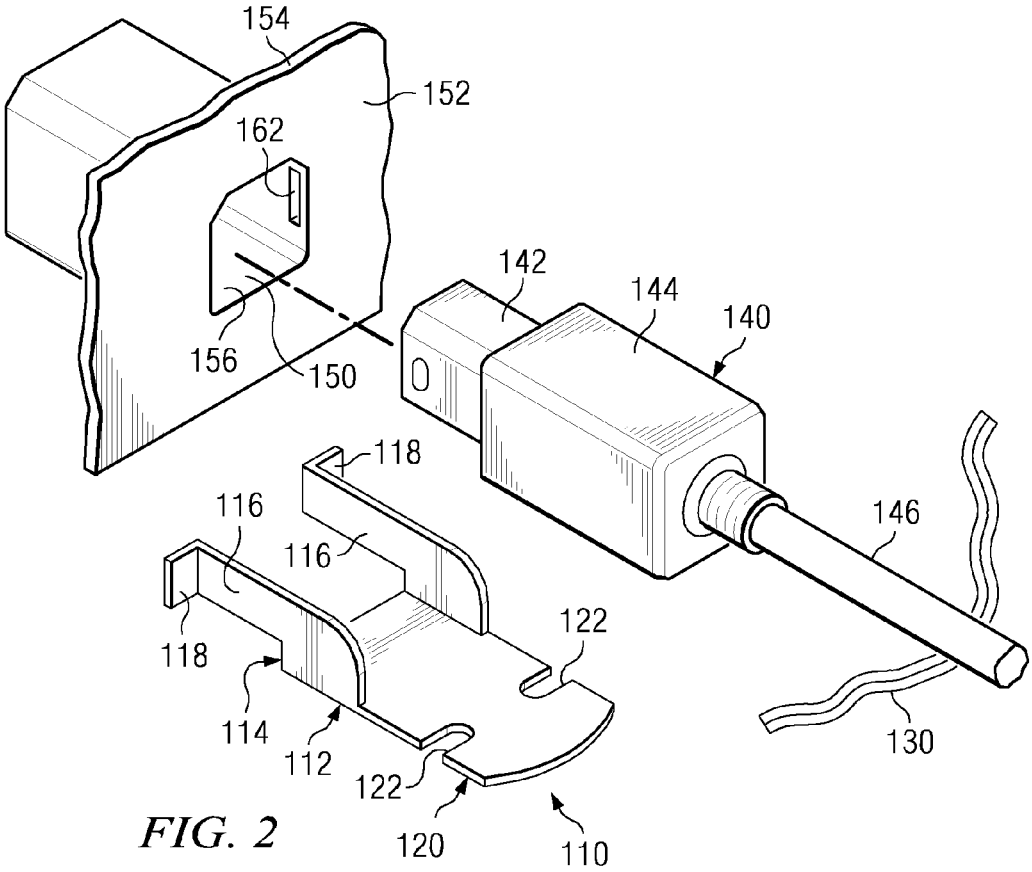
FIG. 2 is an exploded perspective view of a second example retainer to secure a second example connector in a second example port.
Figure 2A:
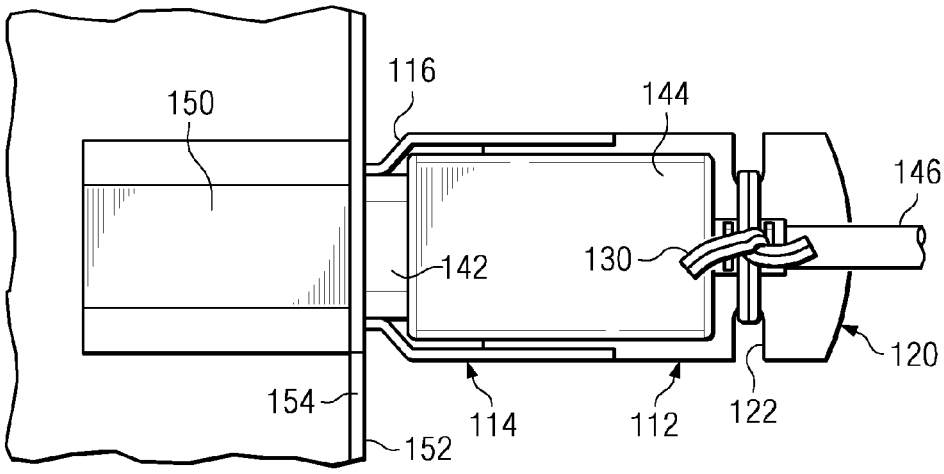
FIG. 2A is a top view of the second example retainer and the second example connector secured to the second example port.

Turning to FIGS. 2 and 2A, an example retainer 110 is provided. In this example, the retainer 110 includes a body 112 and a fastener 130. As with the example retainer 10 of FIG. 1, the body 112 of the example retainer 110 has a projection 114 to engage a housing 154 of an electrical device. In the illustrated example, the projection 114 is implemented by extension arms 116 that run longitudinally with respect to the body 112, and that terminate in flanges 118. The body 112 also has a mount or connector engaging portion 120 extending opposite the housing engaging portion 114. The 120 includes one or more notches 122 dimensioned to receive the fastener 130. In this example, the fastener 130 is implemented as a twist tie having a wire encased in a plastic ribbon. Also, the mount 120 may engage a connector 140 directly or indirectly via the fastener 130. Thus, the fastener 130 (e.g. twist tie) may have one end twisted around the other end to connect the connector 140 to the mount 120, and, in this sense, includes at least one securing portion. The components of the retainer 110 may be connected as described herein and as shown in FIGS. 2 and 2A. The connector 140 may be removed after releasing the fastener 130.

The example retainer 110 of FIGS. 2 and 2A is shown generally, for example, as being dimensioned for use with a USB type B connector 140 that includes an interconnect portion 142, a grasping portion 144 and a cable portion 146 extending opposite the interconnect portion 142. The connector 140 is generally representative of the structure at the distal end of a USB type B cable of a peripheral device (not shown). In this example, a corresponding USB type B jack 150 is constructed integrally with the housing 154 of an electronic device (not shown) having a housing panel 152. To connect the connector 140 to the jack 150, the interconnect portion 142 of the connector 140 passes through a housing opening 156 in the housing panel 152, and into the jack 150. Thus, the jack 150 is integrally formed with the housing panel 152, and is accessible through the housing opening 156. Of course, a jack may be formed so as to stand alone and may be set back from the housing panel 152.

To utilize the example retainer 110 of FIGS. 2 and 2A, the retainer 110 is connected to both the housing 154 and the connector 140. Connection to the connector 140 may be affected either via the grasping portion 144 or the cable portion 146. To connect the retainer 110 to the housing 154, the flanges 118 are deflected inwardly and inserted through the housing opening 156 in the housing panel 152. In the example of FIG. 2, the flanges 118 engage slots 162 in the inner side walls of the jack 150.

The retainer 110 is connected to the connector 140 by moving the connector 140 to a position adjacent the body 112 of the retainer 110, and inserting the interconnect portion 142 of the connector 140 into the jack 150. Then, the fastener 130 is connected to the connector 140 and to the connector engaging portion 120 by locating the fastener 130 within at least one of the notches 122 in the connector engaging portion 120 and encircling the connector 140. Thus, in the example of FIGS. 2 and 2A, the twist tie 130 is looped through the notches 122 of the mount 120, up and around the cable portion 146, and then the two loose ends of the twist tie are twisted together to retain the connector 140. In some examples, the retainer 110 and the connector 140 may be fastened together before the retainer 110 is installed into the jack 150.

Although a twist tie is shown as being used as the fastener 130, it should be noted that the fastener 130 may be implemented as a flexible member such as an elastic band. Furthermore, as described above in conjunction with the example retainer 10 of FIGS. 1 and 1A, a stop or other projection may be used in addition to or in place of the flexible member 130 to secure the connector 140 to the retainer 110 via an interference and/or friction fit.

As with the example retainer 10 of FIG. 1 and FIG 1A, when the example retainer 110 of FIG. 2 is installed, the connector 140 is secured against inadvertent disconnection or removal from the jack 150. The retainer 110 may be readily removed if desired, and/or may be designed to yield under a particular level of removal force. Materials similar to those mentioned with respect to the example retainer 10 of FIGS. 1 and 1A may be used for the body 112 of the retainer 110 of FIGS. 2 and 2A.

Figure 3:
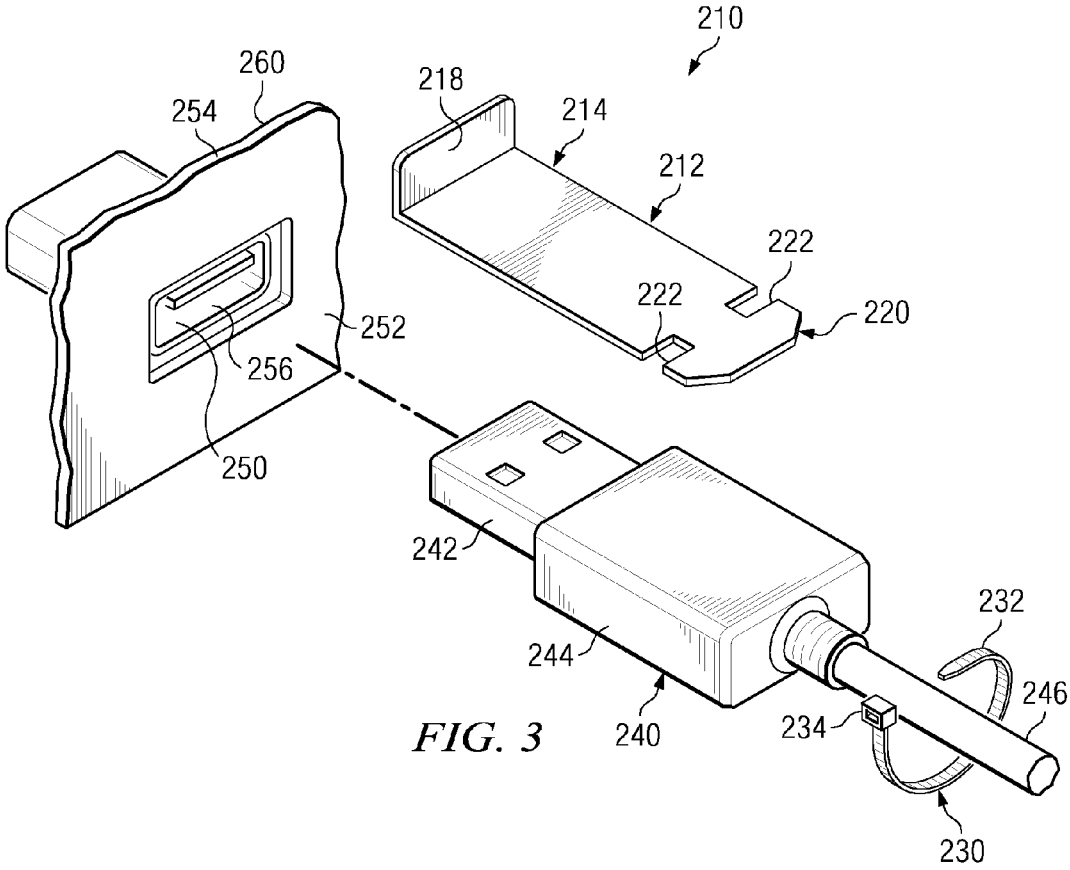
FIG. 3 is an exploded perspective view of a third example retainer to secure a third example connector in a third example port.
Figure 3A:
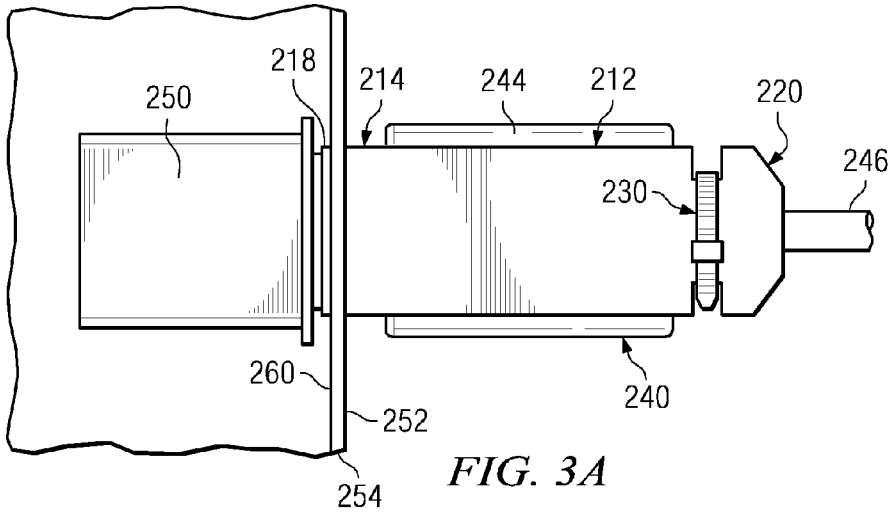
FIG. 3A is a top view of the third example retainer and the third example connector secured to the third example port.

Another example retainer 210 is shown in FIGS. 3 and 3A. The example retainer 210 includes a body 212 and a fastener 230. The body 212 of retainer 210 includes a housing engaging portion 214 that terminates in an upwardly turned projection or flange 218. The flange 218 is positioned substantially perpendicular to the housing engaging portion 214. The body 212 also has a mount or connector engaging portion 220 extending opposite the housing engaging portion 214.

The example mount 220 of FIG. 3 includes one or more notches 222 (two are shown) which are dimensioned to receive the fastener 230. In the example of FIG. 3, the fastener 230 is implemented as a plastic cable tie having a toothed band 232 insertable through a securing portion (e.g. a locking ring) 234. Of course, any other fastener (including, for example, the elastic band and/or the twist tie described herein) may be used in place of, or in addition to, the fastener 230. As with the prior examples, the mount 220 may engage the connector 240 directly or indirectly via the fastener 230. For example, the toothed band 232 of the cable tie 230 may be wrapped around the connector 240 and the mount 220, and the end of the band 232 may be pulled through the locking ring 234 such that the cable tie secures the connector 240 and the retainer 210. The retainer 210 may be connected to a port 250 as shown in FIG. 3A (e.g., with the flange 218 inserted behind a front panel of 252 of a housing 254). The connector 240 may be removed by cutting the fastener 230, or if the fastener 230 is of a releasable type, by releasing, for example, the toothed band 232 from the locking ring 234.

The example retainer 210 shown in FIGS. 3 and 3A is illustrated as being for use with a USB type A connector 240 that includes an interconnect portion 242, a grasping or housing portion 244, and a cable portion 246 extending opposite the interconnect portion 242. The connector 240 is generally representative of the structure at the distal end of a USB type A cable of a peripheral device (not shown). However, in alternative implementations, the connector 240 may form part of a device, such as a USB flash drive, or the like. An example USB type A jack 250 is shown in FIG. 3A. The example jack 250 is similar to the jack 50 discussed above in connections with FIGS. 1 and 1A. The jack 250 is accessible through a housing opening 256 in a housing panel 252 of a housing 254. To connect the connector 240 to the jack 250, the interconnect portion 242 of the connector 240 is passed through the housing opening 256 in the housing panel 252, and into the jack 250.

To utilize the example retainer 210 of FIGS. 2 and 2A, the retainer 210 is connected both to the housing 254 and to the connector 240. The connection to the connector 240 may be affected either via the grasping portion 244 or the cable portion 246. In the example of FIGS. 3 and 3A, the housing opening 256 is larger than is necessary to receive the interconnect portion 242. In fact, the opening 250 is sufficiently large to permit the upstanding flange 218 on the housing engaging portion 214 to be inserted through the housing opening 256 and moved upward so that the upstanding flange 218 is disposed behind the housing panel 252. With the retainer 210 in this position, the connector 240 is moved into place by inserting the interconnect portion 242 of the connector 240 through the housing opening 256 and into the jack 250. It will be appreciated by those having ordinary skill in the art that the body 212 of the example retainer 210 is held upward by the installed connector 240. As a result, the flange 218 is held adjacent (and possibly in engagement with) a rear face 260 of the housing panel 252.

The retainer 210 is also connected to the connector 240 by installing the fastener 230 around the mount 220 and around the connector 240. As shown in FIG. 3A, the connector 240 is disposed beneath the retainer 210. However, the locations can be reversed such that the retainer 210 is located beneath the connector 240. In the example of FIGS. 3 and 3A, the fastener 230 engages the notches 222 of the mount 220 to connect the connector 240 to the retainer 210 and, thus, retain the connector 240 in an installed position. Of course, any other fastener(s) (e.g., an elastic band, a twist tie, an interfering structure to create an interference fit, etc.) may be used to secure the mount 220 to the connector 240.

As with the prior examples, when the example retainer 210 of FIGS. 3 and 3A is installed, the connector 240, and, in particular, the interconnect portion 242, is prevented from being inadvertently disconnected or removed from the jack 250. The retainer 210 may be intentionally removed when desired, and/or may be designed to yield when subjected to a particular level of removal force. The materials for the body 212 of the retainer 210 may be similar to those mentioned above with respect to other examples, however, it will be appreciated by one of ordinary skill in the art that a thicker and/or more rigid material is desirable for this example which is intended to resist bending.

Figure 4:
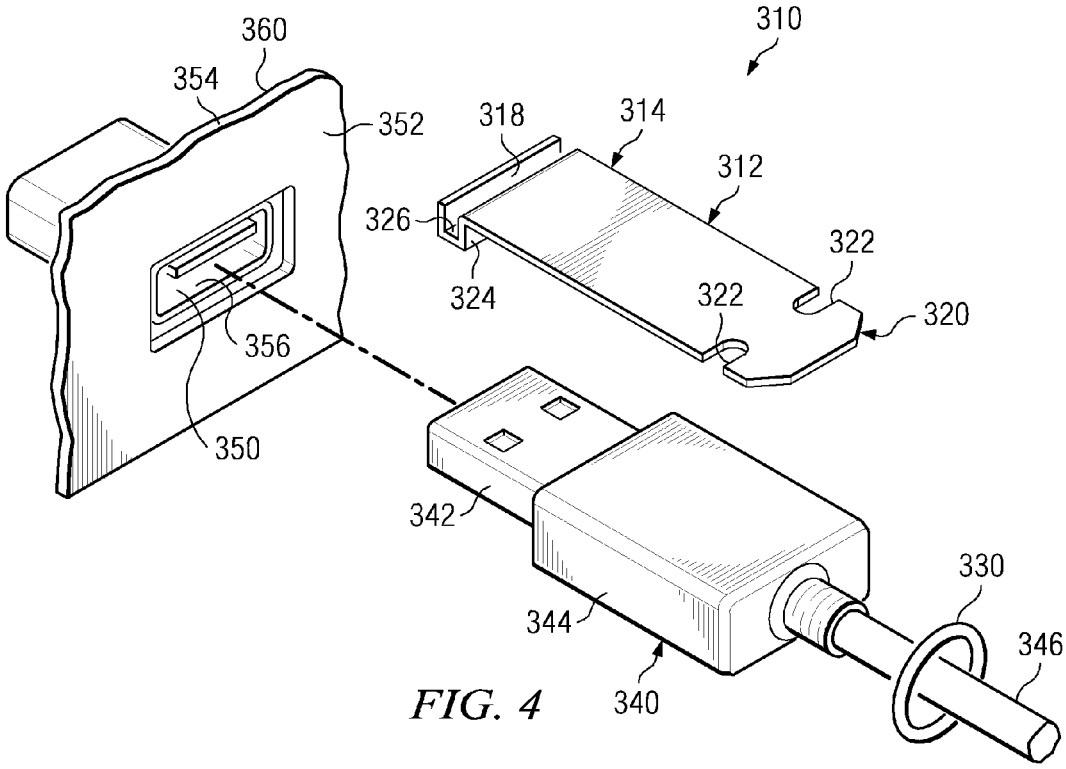
FIG. 4 is an exploded perspective view of a fourth example retainer to secure a fourth example connector in a fourth example port.
Figure 4A:
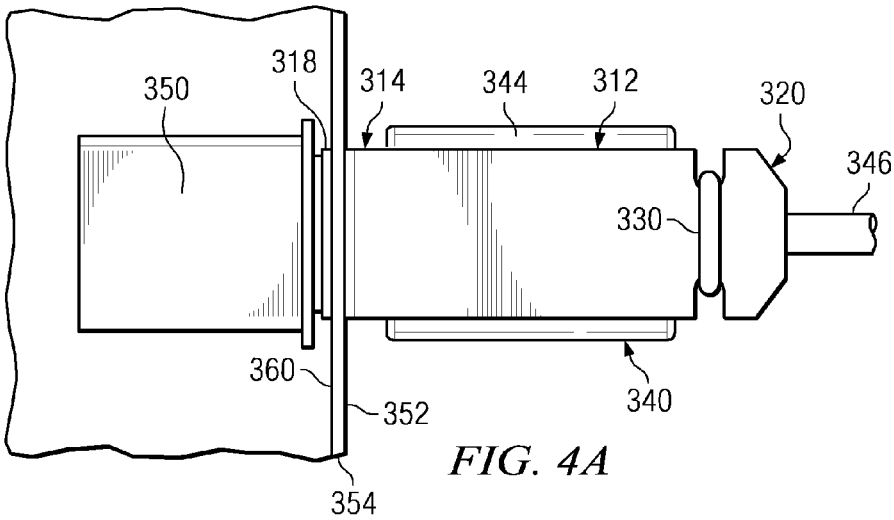
FIG. 4A is a top view of the fourth example retainer and the fourth example connector secured to the fourth example port.

Another example retainer 310 is shown in FIGS. 4 and 4A. In the example of FIGS. 4 and 4A, the retainer 310 includes a body 312 and a fastener 330. The body 312 of the retainer 310 includes a housing engaging portion 314 that includes a first portion 324 bent substantially perpendicular to and downward from the body 312, a second portion 326 substantially parallel to the body 312, and a third portion, flange, or projection 318 that is substantially perpendicular to the body 312 and directed upward from the second portion 326. The body 312 also has a mount or connector engaging portion 320 extending opposite the housing engaging portion 314. The mount 320 of the illustrated example includes one or more notches 322 to receive the fastener 330. In the example of FIG. 4, the fastener 330 is implemented as a resilient band. However, any other fastener or retention structure may be used to secure the connector 340 to the mount 320. In the illustrated example, the fastener 330 is wrapped around the connector 340 and the mount 320 of the retainer 310. The retainer 310 may be connected to a port 350 shown in FIG. 4A (e.g., with the flange 318 inserted behind the front panel 352 of the housing). The connector 340 may be removed by stretching and moving the fastener 330 out of a connector holding position, or by being cut.

The retainer 310 in FIGS. 4 and 4A is shown generally, for example, as being for use with a USB type A connector 340 that includes an interconnect portion 342, am grasping or housing portion 344 and a cable portion 346 extending opposite the interconnect portion 342. However, the cable portion 346 need not be provided (for example, the USB type A connector 340 may be a portion of a device that does not need a cable such as a flash drive). The connector 340 of the illustrated example is generally representative of the structure at the distal end of a USB type A cable of a peripheral device (not shown). An example USB type A jack 350 is shown in FIGS. 4 and 4A. The example jack 350 is similar to the jack 50 discussed above in connection with FIGS. 1 and 1A. The jack 350 is accessible through a housing opening 356 in a housing panel 352 of a housing 354 of an electronic device. To connect the connector 340 to the jack 350, the interconnect portion 342 of the connector 340 is passed through the housing opening 356 in the housing panel 352, and into the jack 350.

To utilize the example retainer 310 of FIGS. 4 and 4A, the retainer 310 is connected to both the housing 354 and the connector 340. The connection to the connector 340 may be affected either via the grasping portion 344 or the cable portion 346. In this example, the housing opening 356 is like that shown in FIG. 1, and is not significantly larger than the jack 350. Thus, the housing opening 356 is large enough to receive the interconnect portion 342, but is not sufficiently large to permit the body 312 of the example retainer 310 of FIG. 4 to lie atop the connector 340 while being connected to the housing 354. To accommodate this spacing, the housing engaging portion 314 of the example retainer 310 of FIG. 4 includes the first, second and third portions 324, 326 and 318, which create a jog to permit the upstanding flange 318 on the housing engaging portion 314 to be inserted through the housing opening 356 and moved upward into engagement with the housing 354. The connector 340 is then moved into place by inserting the interconnect portion 342 of the connector 340 through the housing opening 356 and into the jack 350. The body 312 of the retainer 310 is held upward by the installed connector 340. As a result, the flange 318 is held behind (and possibly in engagement with) a rear face 360 of the housing panel 352.

In the illustrated example, the retainer 310 is connected to the connector 340 disposed immediately adjacent the mount 320 by looping the resilient band (or any other fastener) 330 around the mount 320, through at least one of the notices 322, and around the connector 340. In alternative examples, the fastener 330 may be eliminated and one or more portions of the body 312 may be bent upward and/or the body 312 may be provided with one or more projections to retain the connector 340 to the mount 320. However, in the example of FIGS. 4 and 4A, the continuous resilient band 330 secures the mount 320 to the connector 340 so that the retainer 310 retains the connector 340 in an installed position when subjected to inadvertent removal forces.

When the example retainer 310 of FIG. 4 is installed, the connector 340 is prevented from being inadvertently disconnected or removed from the jack 350. The retainer 310 may be removed if desired, and/or may be designed to yield under a particular level of removal force. Also, the body 312 of the retainer 310 may be constructed of materials similar to those mentioned with respect to the prior example in FIGS. 3 and 3A.

Figure 5:
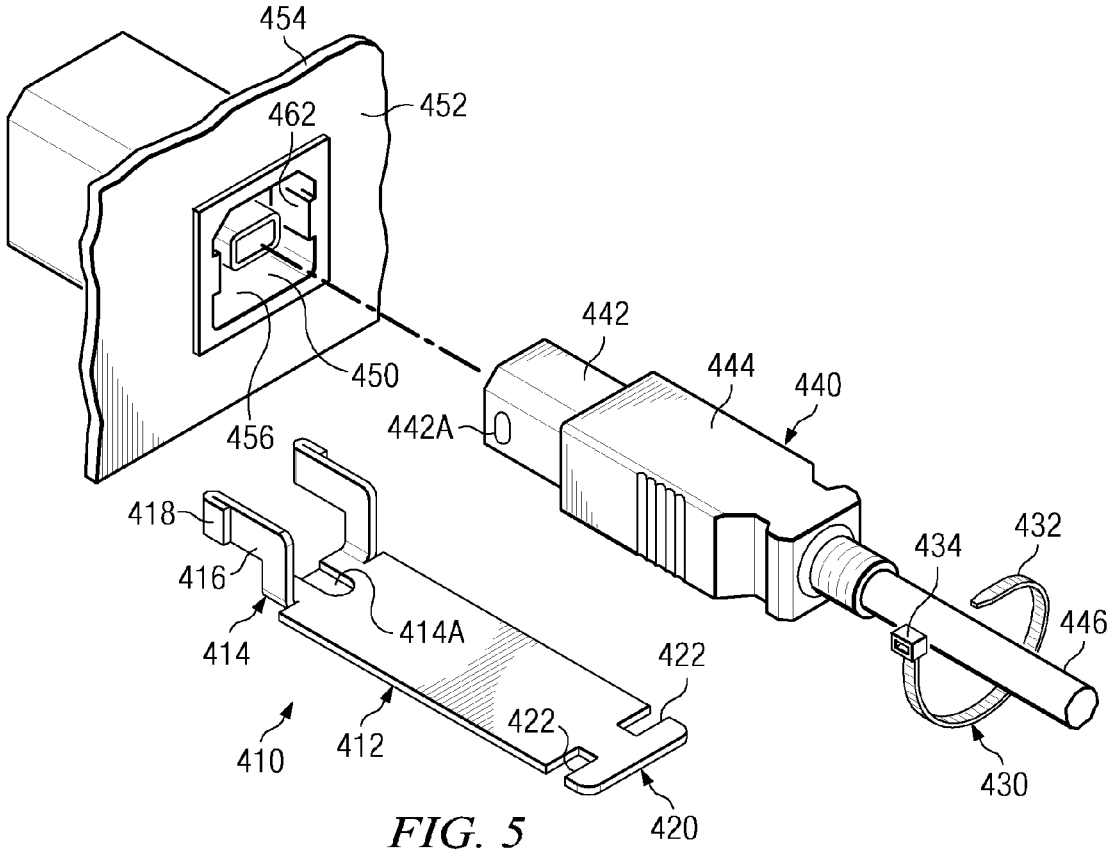
FIG. 5 is an exploded perspective view of a fifth example retainer to secure a fifth example connector in a fifth example port.
Figure 5A:
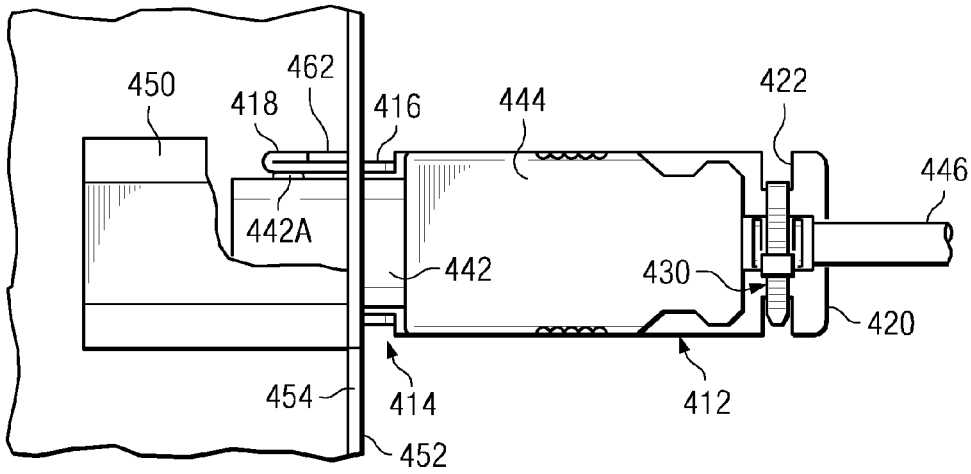
FIG. 5A is a top view of the fifth example retainer and the fifth example connector secured to the fifth example port.

Turning to FIGS. 5 and 5A, an example retainer 410 is provided. In this example, the retainer 410 includes a body 412 and a fastener 430. As with the example retainer 10 of FIGS. 1 and 1A, the body 412 of the example retainer 410 has a projection 414 to engage a housing 454 of an electrical device. In the illustrated example, the projection 414 is implemented by extension arms 416 that run longitudinally with respect to the body 412, and that terminate in hemmed flanges 418, which are bent back against the extension arms 416. The body 412 may benefit from increased stiffness by locating an embossment 414A in the region of the projection 414. The body 412 also has a mount or connector engaging portion 420 extending opposite the projection 414. The mount 420 includes one or more notches 422 (two are shown) which are dimensioned to receive the fastener 430. In the example of FIG. 5, the fastener 430 is implemented as a plastic cable tie having a toothed band 432 insertable through a securing portion (e.g. a locking ring) 434. Of course, any other fastener (including, for example, the elastic band and/or the twist tie described herein) may be used in place of, or in addition to, the fastener 430. As with the prior examples, the mount 420 may engage a connector 440 directly or indirectly via the fastener 430. For example, the toothed band 432 of the cable tie 430 may be wrapped around the connector 440 and the connector engaging portion 420, and the end of the band 432 may be pulled through the locking ring 434 such that the cable tie secures the connector 440 and the retainer 410. The connector 440 may be removed by cutting the fastener 430, or if the fastener 430 is of a releasable type, by releasing, for example, the toothed band 432 from the locking ring 434.

The retainer 410 of FIGS. 5 and 5A is shown generally, for example, as being dimensioned for use with a USB type B connector 440 that includes an interconnect portion 442 with a side detent 442A on respective sides thereof, a grasping portion 444 and a cable portion 446 extending opposite the interconnect portion 442. The connector 440 is generally representative of the structure at the distal end of a USB type B cable of a peripheral device (not shown). In this example, a corresponding USB type B jack 450 is mounted generally flush with a housing panel 452 of the housing 454 of an electronic device (not shown). The housing panel 452 includes an opening 456 to allow access to the jack 450 from outside the housing 454. To couple the connector 440 to the jack 450, the interconnect portion 442 of the connector 440 is passed through the opening 456 in the housing panel 452, and into the jack 450 to make electrical connection therewith. In other words, the body of the jack 450 is mounted within the housing 454, generally extends behind the housing panel 452, and is accessible through the housing opening 456. Of course, the jack 450 may be in alternative configurations, such as integrally formed with the housing panel 452, and accessible through the housing opening 456, or formed and located so as to be set back from the housing panel 452.

To utilize the example retainer 410 of FIGS. 5 and 5A, the retainer 410 is connected to both the housing 454, via the jack 450, and the connector 440. Connection to the connector 440 may be affected either via the grasping portion 444 or the cable portion 446. To connect the retainer 410 to the housing 454 and the jack 450, the extension arms 416 having hemmed flanges 418 at their distal ends are inserted directly into the jack 450 until the body 412 abuts the housing front panel 452. In the example of FIG. 5, the hemmed flanges 418 on the extension arms 416 engage side leaves 462 disposed along the respective inner side walls of the jack 450. The extension arms 416 are configured to have a length sufficient to place the hemmed flanges 418 just behind the side leaves 462 within the jack 450 when the retainer 410 is inserted to an operative position.

With the retainer 410 inserted into the jack 450, when the interconnect portion 442 of the connector 440 is inserted through the housing opening 456 in the housing panel 452 and into the jack 450, the sides of the interconnect portion 442, with their detents 442A, force the extension arms 416 outward against the side leaves 462 of jack 450. This causes the hemmed flanges 418 to be disposed behind the side leaves 462, thereby blocking withdrawal of the flanges 418.

The retainer 410 is connected to the connector 440 by moving the connector 440 to a position adjacent the body 412 of the retainer 410, and inserting the interconnect portion 442 of the connector 440 through the housing opening 456 and into the jack 450. In this example, the fastener 430 is connected to the connector 440 and to the mount 420 by locating the fastener 430 within at least one of the notches 422 in the mount 420 and encircling the cable portion 446 of connector 440. As shown in FIG. 5A, the connector 440 is disposed beneath the retainer 410. However, the locations can be reversed such that the retainer 410 is located beneath the connector 440. In the example of FIGS. 5 and 5A, the fastener 430 engages the notches 422 of the mount 420 to connect the connector 440 to the retainer 410 and, thus, retain the connector 440 in an installed position. Of course, any other fastener(s) (e.g., an elastic band, a twist tie, an interfering structure to create an interference fit, etc.) may be used to secure the mount 420 to the connector 440. As with the prior examples, it should be noted that the fastener 430 may be implemented in another form of a flexible member, such as an elastic band. Furthermore, as previously described in conjunction with the example retainer 10 of FIGS. 1 and 1A, a stop or other projection may be used in addition to or in place of the flexible member 430 to secure the connector 440 to the retainer 410 via an interference and/or friction fit.

As with the example retainer 10 of FIG. 1, when the example retainer 410 of FIG. 5 is installed, the connector 440 is secured against inadvertent disconnection or removal from the jack or receptacle 450. The retainer 410 may be readily removed if desired by reversing the installation procedure, and/or may be designed to yield under a particular level of removal force. Materials similar to those mentioned with respect to the example retainer 10 may be used for the body 412 of the retainer 410.

Figure 6:
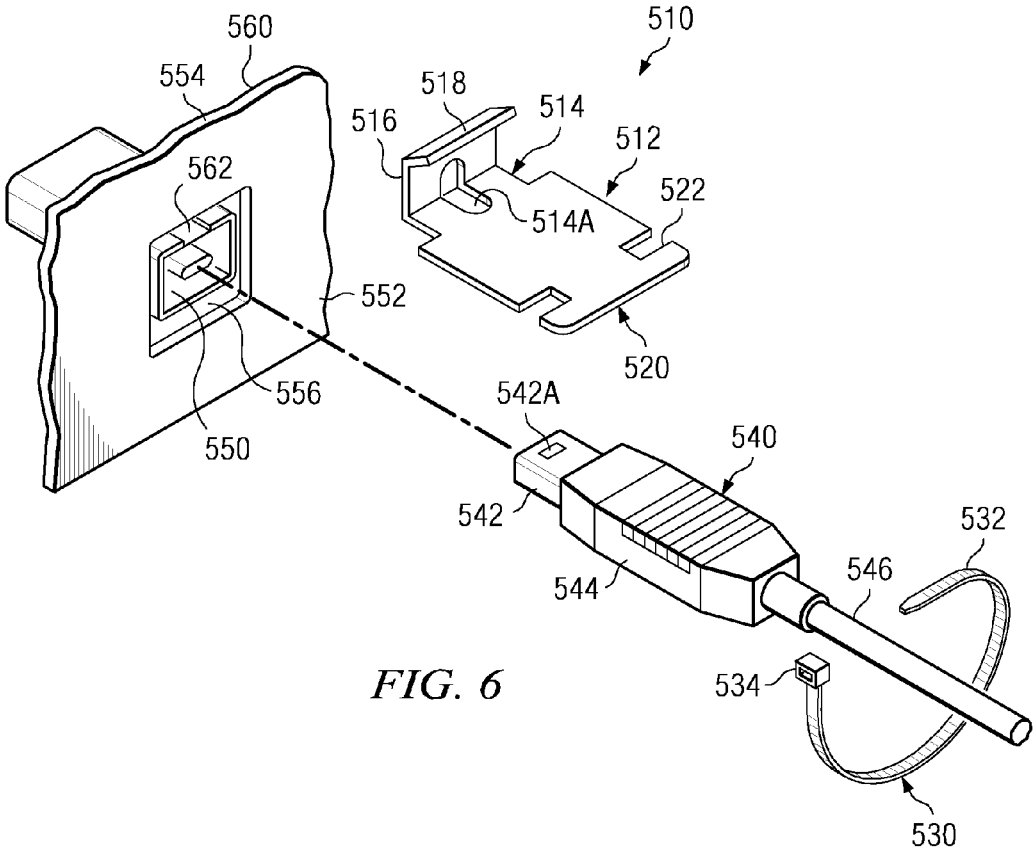
FIG. 6 is an exploded perspective view of a sixth example retainer to secure a sixth example connector in a sixth example port.
Figure 6A:
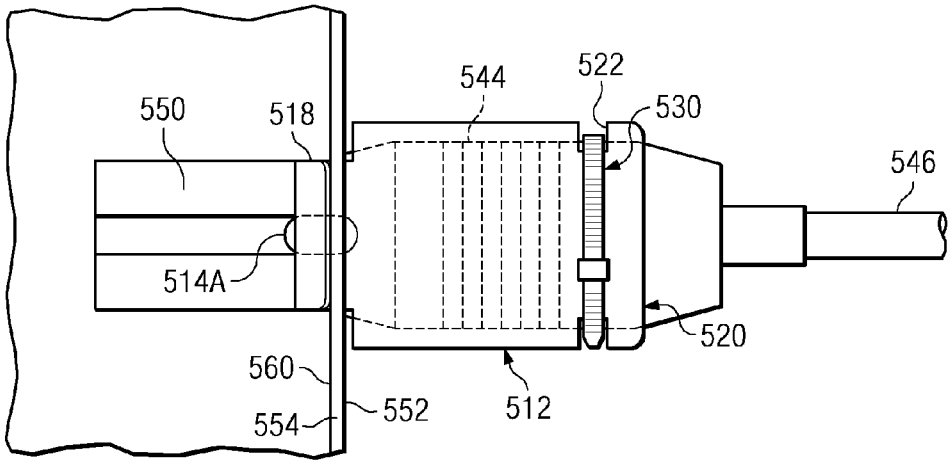
FIG. 6A is a top view of the sixth example retainer and the sixth example connector secured to the sixth example port.

Another example retainer 510 is shown in FIGS. 6 and 6A. The example retainer 510 includes a body 512 and a fastener 530. The body 512 of the retainer 510 includes a housing engaging portion 514 having an upwardly extending extension arm 516 that terminates in a forwardly bent projection or flange 518. The body 512 may benefit from increased stiffness by locating an embossment 514A in the region of the housing engaging portion 514, and the embossment 514A may extend upward into the extension arm 516 as well. The body 512 also has a mount or connector engaging portion 520 extending opposite the housing engaging portion 514.

The example mount 520 of FIG. 6 includes one or more notches 522 (two are shown) which are dimensioned to receive the fastener 530. In the example of FIG. 6, the fastener 530 is implemented as a plastic cable tie having a toothed band 532 insertable through a securing portion (e.g. a locking ring) 534. Of course, any other fastener (including, for example, the elastic band and/or the twist tie described herein) may be used in place of, or in addition to, the fastener 530. As with the prior examples, the mount 520 may engage the connector 540 directly or indirectly via the fastener 530. For example, the toothed band 532 of the cable tie 530 may be wrapped around the connector 540 and the mount 520, and the end of the band 532 may be pulled through the locking ring 534 such that the cable tie secures the connector 540 and the retainer 510. The retainer 510 may be connected to the housing 554 as shown in FIG. 6A (e.g., with the flange 518 inserted behind the front panel of 552 of the housing). The connector 540 may be removed by cutting the fastener 530, or if the fastener 530 is of a releasable type, by releasing, for example, the toothed band 532 from the locking ring 534.

The example retainer 510 shown in FIGS. 6 and 6A is illustrated as being for use with a VAS type connector 540 that includes an interconnect portion 542 with a detent portion 542A on its upper side, a grasping or housing portion 544, and a cable portion 546 extending opposite the interconnect portion 542. The connector 540 is generally representative of the structure at the distal end of a VAS type cable of a peripheral device (not shown). However, in alternative implementations, the connector 540 may form part of a device not having a cable.

An example VAS type jack or receptacle 550 is shown in FIG. 6A. The example jack 550 is accessible through a housing opening 556 in a housing panel 552 of a housing 554. To connect the connector 540 to the jack 550, the interconnect portion 542 of the connector 540 is passed through the housing opening 556 in the housing panel 552, and into the jack 550, with the detent portion 542A contacting the underside of an upper band 562 in the jack 550.

To utilize the example retainer 510, the retainer 510 is connected both to the housing 554 and to the connector 540. The connection to the connector 540 may be affected either via the grasping portion 544 or the cable portion 546. In the example of FIGS. 6 and 6A, the housing opening 556 is larger than is necessary to receive the interconnect portion 542. In fact, the opening 550 is sufficiently large to permit the upstanding portion of the extension arm 516 and the flange 518 on the housing engaging portion 514 to be inserted through the housing opening 556 and moved upward so that the upstanding flange 518 is disposed behind the housing panel 552, and the embossment 514A engages the upper side of the upper band 562 of the receptacle 550. With the flange 518 located behind the housing panel 552, the body 512 may be rotated downward toward a level position while the embossment 514A acts as a pivot to move the flange 518 adjacent to and possibly into engagement with the rear face 560 of the housing panel 552. With the retainer 510 in this installed position, the connector 540 is moved into place by inserting the interconnect portion 542 of the connector 540 through the housing opening 556 and into the jack 550. It will be appreciated by those having ordinary skill in the art that the body 512 of the example retainer 510 is held upward by the installed connector 540. As a result, the flange 518 is held adjacent (and possibly in engagement with) the rear face 560 of the housing panel 552.

The retainer 510 is also connected to the connector 540 by installing the fastener 530 around the mount 520 and around the connector 540. As shown in FIG. 6A, the connector 540 is disposed beneath the retainer 510. However, the locations can be reversed such that the retainer 510 is located beneath the connector 540. In the example of FIGS. 6 and 6A, the fastener 530 engages the notches 522 of the mount 520 to connect the connector 540 to the retainer 510 and, thus, retain the connector 540 in an installed position. Of course, any other fastener(s) (e.g., an elastic band, a twist tie, an interfering structure to create an interference fit, etc.) may be used to secure the mount 520 to the connector 540.

As with the prior examples, when the example retainer 510 of FIGS. 6 and 6A is installed, the connector 540, and, in particular, the interconnect portion 542, is prevented from being inadvertently disconnected or removed from the jack 550. The retainer 510 may be intentionally removed by reversing the installation procedure when desired, and/or may be designed to yield when subjected to a particular level of removal force. The materials for the body 512 of the retainer 510 may be similar to those mentioned above with respect to the examples in FIGS. 3 and 3A, as well as in FIGS. 4 and 4A.

Although the above examples utilize a projection behind or within a wall of a housing to secure a retainer to an electronic device, other arrangements are possible. For example, the projection may be implemented as a flange that is fastened to an outer surface of the housing adjacent a receptacle by a fastener (e.g., a screw, glue, etc.) and/or may be integrally formed with the housing of an electronic device.

Although certain examples of apparatus, methods and/or articles of manufacture have been described herein, the scope of coverage of this patent is not limited thereto. On the contrary, this patent covers all apparatus, methods and articles of manufacture fairly falling within the scope of the appended claims either literally or under the doctrine of equivalents.

What is claimed is:

1. A connector retainer to retain a connector in a receptacle in a housing of an electronic device, the retainer comprising:

a projection to engage the housing through the an opening in the housing to secure the retainer to the housing, wherein the projection is dimensioned to penetrate the opening adjacent an electronic projection of the connector which is also penetrating the opening; and a mount adjacent the projection to secure the connector to the projection, wherein the mount comprises a notch to receive at least a portion of a fastener used to secure the connector to the mount.

2. A connector retainer as defined in claim 1, wherein the fastener is removable.

3. A connector retainer as defined in claim 1, wherein the fastener is reusable.

4. A connector retainer as defined in claim 1, wherein the fastener further comprises an elastic band.

5. A connector retainer as defined in claim 4, wherein the band is continuous.

6. A connector retainer as defined in claim 1, wherein the fastener further comprises a securing portion.

7. A connector retainer as defined in claim 1, wherein the projection comprises a flange to engage a wall of the housing.

8. A connector retainer as defined in claim 7, wherein the flange extends substantially perpendicularly relative to the mount.

9. A connector retainer as defined in claim 7, wherein the flange is structured to extend vertically above or below the opening.

10. A connector retainer as defined in claim 7, wherein the projection comprises a pair of opposed flanges to engage a wall of the housing.

11. A connector retainer as defined in claim 10, wherein the projection further comprises a pair of extension arms and each of the opposed flanges extends from a respective one of the extension arms.

12. A connector retainer as defined in claim 1, wherein the connector comprises a USB connector.

13. A method to retain a connector in a receptacle in a housing of an electronic device, the method comprising:

inserting a retainer through an opening in the housing, wherein the opening is to receive an electronic projection of the connector;

connecting the connector to the receptacle through the opening with the retainer remaining positioned within the opening; and connecting the connector to the retainer such that both the retainer and the connector pass through the same opening and are secured to the housing, wherein connecting the connector to the retainer comprises threading at least a portion of a fastener through a notch in the retainer.

14. A method as defined in claim 13, wherein inserting the retainer through the opening comprises inserting a flange of the retainer behind a panel of the housing.

15. A method as defined in claim 14, wherein the flange extends at least one of above or below the opening of the jack.

16. A method as defined in claim 13, wherein inserting the retainer through the opening comprises engaging a pair of flanges of the retainer with a panel of the housing.

17. A method as defined in claim 13, wherein the fastener comprises a flexible member.

18. A method as defined in claim 13, wherein the fastener is removable.

19. A method as defined in claim 13, wherein connecting the connector to the receptacle occurs after inserting the retainer through the opening.

20. A method as defined in claim 13, wherein connecting the connector to the receptacle occurs substantially simultaneously with inserting the retainer through the opening.

* * * * *

UNITED STATES PATENT AND TRADEMARK OFFICE

CERTIFICATE OF CORRECTION

PATENT NO. : 7,559,788 B2
APPLICATION NO. : 11/933920
DATED : July 14, 2009
INVENTOR(S) : Ronald W. Legg It is certified that error appears in the above-identified patent and that said Letters Patent is hereby corrected as shown below:

Col. 12 line 14: replace “the an opening” with -- an opening --.

Signed and Sealed this

Twenty-ninth Day of September, 2009

David J. Kappos

David J. Kappos
*Director of the United States Patent and Trademark Office*